US006357247B1

(12) United States Patent
Moretti

(10) Patent No.: US 6,357,247 B1
(45) Date of Patent: Mar. 19, 2002

(54) FAN MOTOR MOUNT

(75) Inventor: Stephen L. Moretti, Auburn, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/859,099

(22) Filed: May 16, 2001

(51) Int. Cl.[7] ..... F25D 23/12
(52) U.S. Cl. ..... 62/262; 62/298
(58) Field of Search ..... 62/262, 298

(56) References Cited

U.S. PATENT DOCUMENTS 4,452,417 A * 6/1984 Krafefer et al. ..... 248/604
4,773,232 A * 9/1988 Lang et al. ..... 62/298
4,800,734 A * 1/1989 Sauber et al. ..... 62/263
5,488,259 A * 1/1996 Cho ..... 310/91
5,622,058 A * 4/1997 Ramakrishnan et al. ..... 62/295
5,732,565 A * 3/1998 Ramakrishnan et al. ..... 62/298
6,065,733 A * 5/2000 Correa et al. ..... 248/675

* cited by examiner

*Primary Examiner*—William Doerrler
*Assistant Examiner*—Mark Shulman
(74) *Attorney, Agent, or Firm*—Wall, Marjama & Bilinski, LLP

(57) ABSTRACT

In an air conditioning unit having a base pan and a vertical divider wall mounted upon the base pan. The unit further includes a fan motor having an annular bolting flange surrounding the motor casing. The motor is supported in a motor mount having a vertically disposed front panel with a hole for receiving the motor casing. The motor flange is bolted to the panel. The mount further includes a pair of side walls and a top wall. A vertically disposed mounting strip is mounted along the outer edge of the top wall and is secured to the divider wall of the unit. A horizontally disposed mounting strip is mounted along the bottom edge of the panel and is secured to the base pan of the unit.

8 Claims, 4 Drawing Sheets

FAN MOTOR MOUNT

FIELD OF THE INVENTION

This invention relates generally to apparatus for mounting a fan motor within an air conditioning unit, and in particular, within a packaged terminal air conditioner (PTAC).

BACKGROUND OF THE INVENTION

In many hotels and motels the air in rooms or other similar areas is conditioned by packaged terminal air conditioning units. This type of unit is generally contained within a sleeve that passes through an outside wall of the room being serviced. The unit is separated into an indoor section and an outdoor section by a divider wall. Each section, in turn, contains a heat exchanger and a fan for conducting air through the associated heat exchanger. A single fan motor is employed to drive both the indoor fan and the outdoor fan via drive shafts that extend outwardly from the front and the rear of the motor casing. The motor is housed in the outdoor section of the unit to reduce the amount of operational noise within the indoor area being serviced and to more expediently dissipate motor heat to the surrounding ambient. Most sleeves are of a standard size thus limiting the amount space available in which to mount the motor fan.

The motor shaft servicing the indoor fan must pass through the dividing wall and is typically longer than that servicing the outdoor fan. In addition, the design of the two fans will be different in order to meet the demands of the indoor and outdoor sections. As a result, a certain amount of imbalance is found in the motor and fan assembly that can produce unwanted vibrations in the unit in the even the motor is not securely mounted. Because of space limitations and the general construction of the units found in the prior art, securely mounting this kind of motor with a PTAC type unit has long posed a problem in the art.

SUMMARY OF THE INVENTION

It is a primary object of this invention to improve air conditioning units and, in particular, PTAC type units.

It is a further object of the present invention to securely mount a fan motor within an air conditioning unit.

It is a still further object of the present invention to provide a stable and secure motor support that can be mounted within the limited space available in a PTAC type air conditioner.

Another object of the present invention is to provide a very simple motor mount for use in a PTAC type unit that will securely support a single motor for driving both fans of a PTAC type unit in a relatively vibration free manner.

These and other objects of the present invention are attained in a PTAC type air conditioning unit that has a vertical divider wall for separating the indoor section of the unit from the outdoor section and a single motor arranged to drive both the indoor and outdoor fans of the unit. The motor is supported in a motor mount having a rectangular vertically disposed panel containing an opening for receiving the motor casing therein and holes for receiving threaded fasteners for securing the mounting flange of the motor to the panel. The mount further includes a pair of side walls extending along the side edges of the panel and a top wall extending along the top edge of the panel. A vertical mounting strip extends along the outer edge of the top wall that is securable to the divider wall by threaded fasteners and a horizontal mounting strip extends along the bottom edge of the panel and is securable to the base pan of the unit by threaded fasteners.

BRIEF DESCRIPTION OF THE DRAWING

For a further understanding of these and objects of the invention, reference will be made to the following detailed description of the invention which is to be read in connection with the accompanying drawing, wherein.

DETAILED DESCRIPTION OF THE INVENTION

Figure 1:
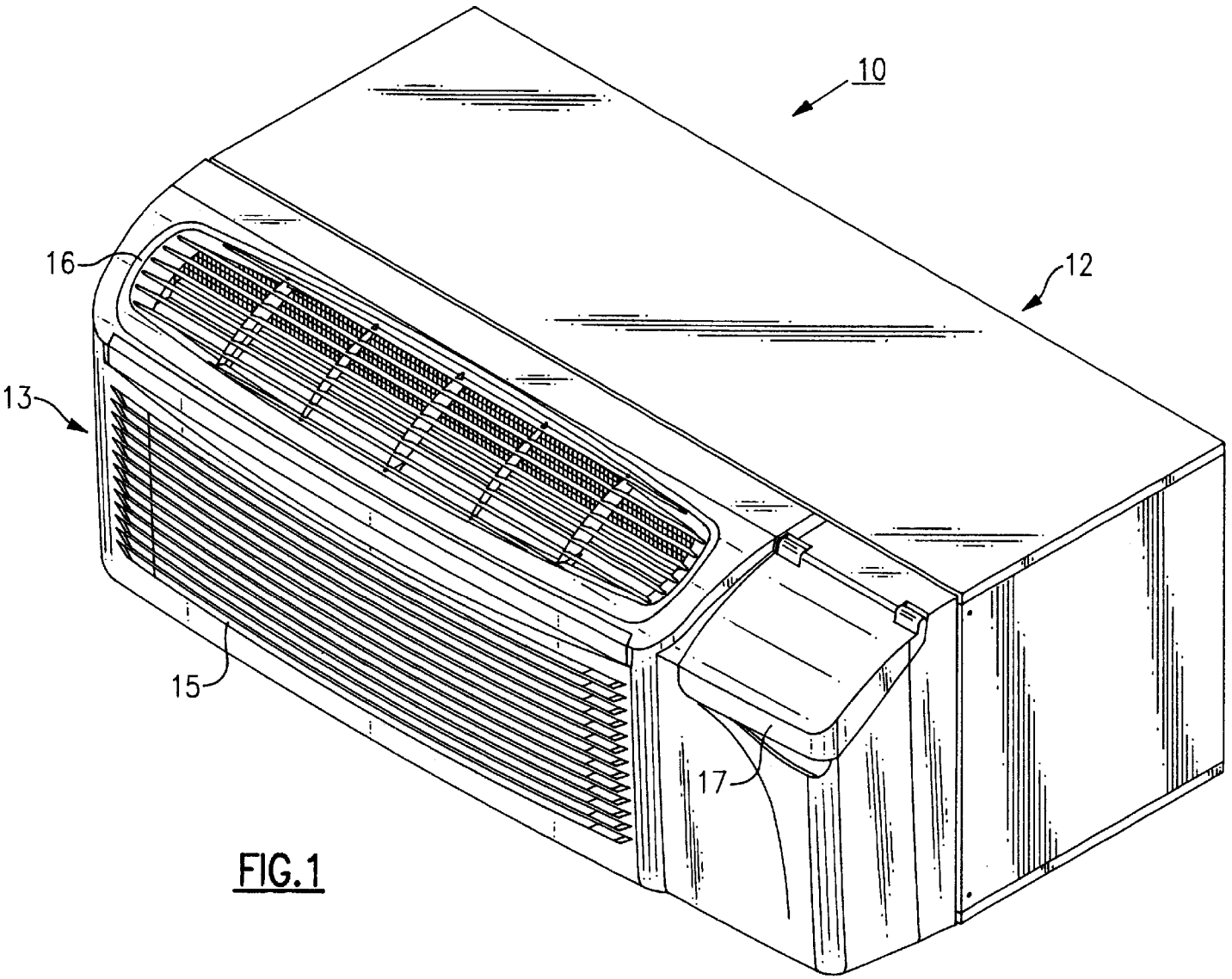
FIG. 1 is a front perspective view of an air conditioning unit embodying the teachings of the present invention.

Turning initially to FIG. 1, there is illustrated a PTAC type air conditioning unit, generally referenced 10, that embodies the teachings of the present invention. The unit is housed within a sleeve 12 that is contained within an outside wall of the room or indoor area being serviced by the unit. The front part of the unit is closed by a front cover 13 that fits tightly against the sleeve in assembly. The cover contains an air inlet opening 15 through which indoor air is drawn into the unit and a second outlet opening 16 through which conditioned air is returned to the area being serviced. Although not shown, the controls for the unit are located in a recessed well behind the front cover and access to the controls is gained through a door 17 that is hinged to the cover.

As noted above, the sleeve 12 is typically fabricated to standard dimensions so that different units provided by various manufacturers can be interchangeably mounted within the sleeve. Accordingly, the amount of space afforded the air conditioning unit is generally limited which, in turn, limits the amount of space available to mount the fan motor.

Figure 2:
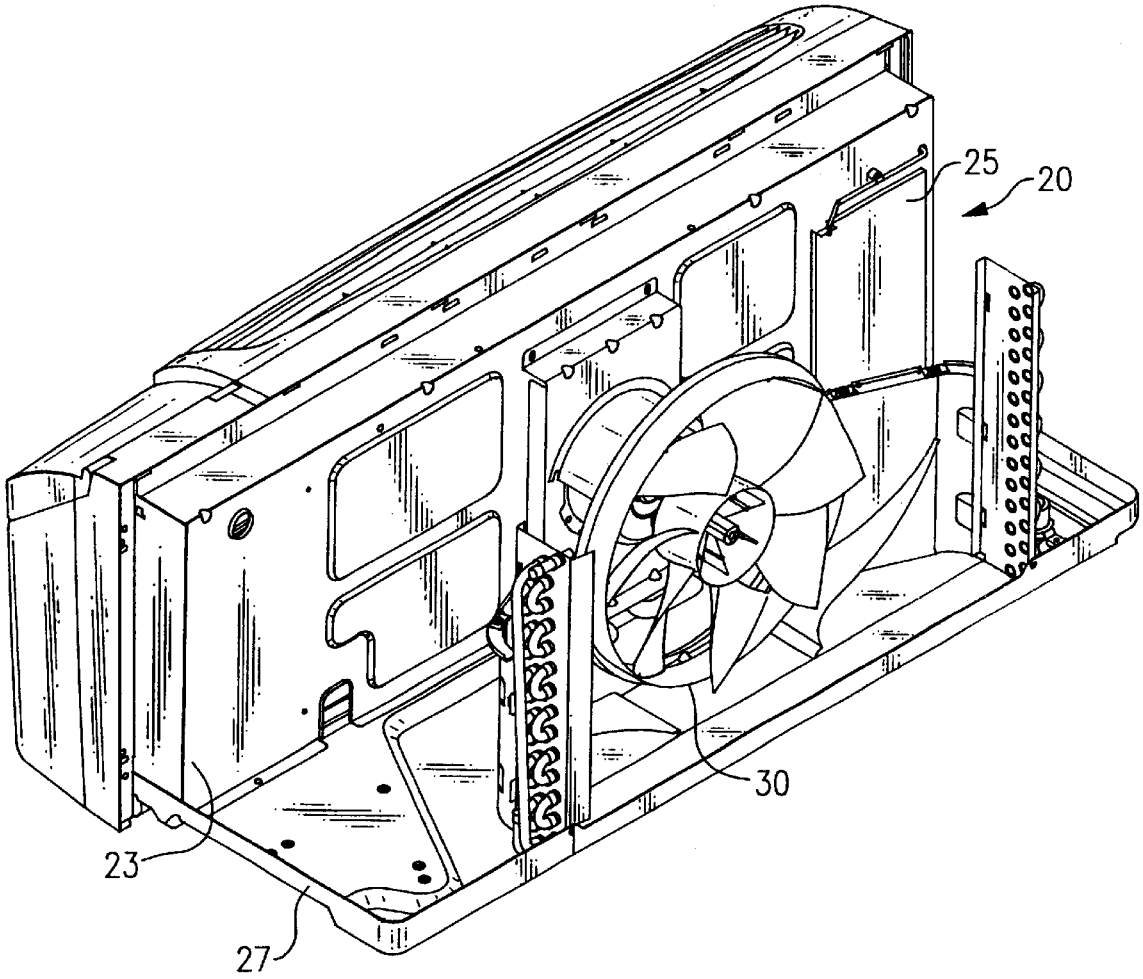
FIG. 2 is a rear perspective view of the air conditioning unit illustrated in FIG. 1 with parts broken away to show the outdoor fan and heat exchanger of the unit.
Figure 3:
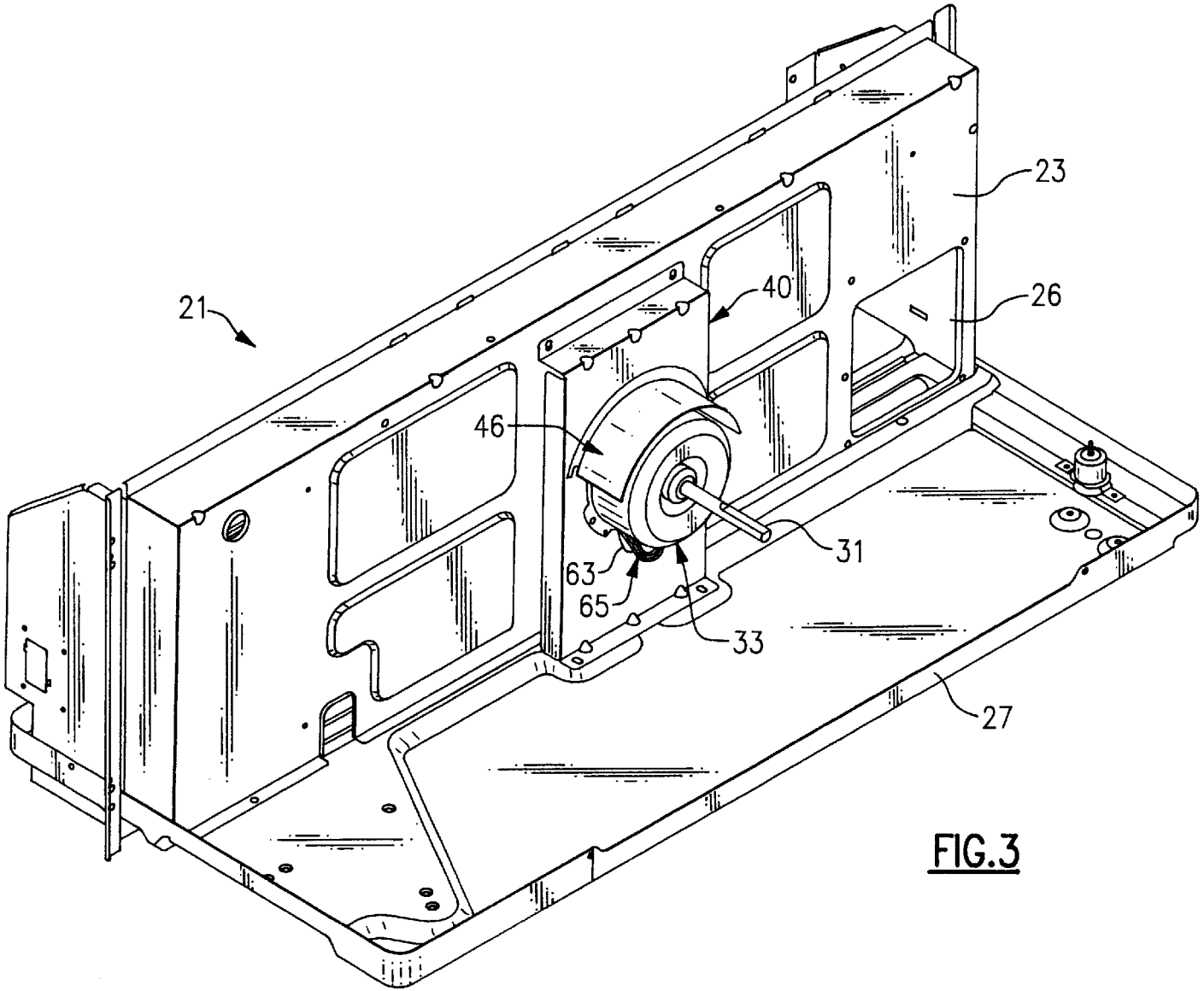
FIG. 3 is a further rear perspective view of the present air conditioning unit with the outdoor fan and heat exchanger removed to better show the motor mount of the present invention.
Figure 4:
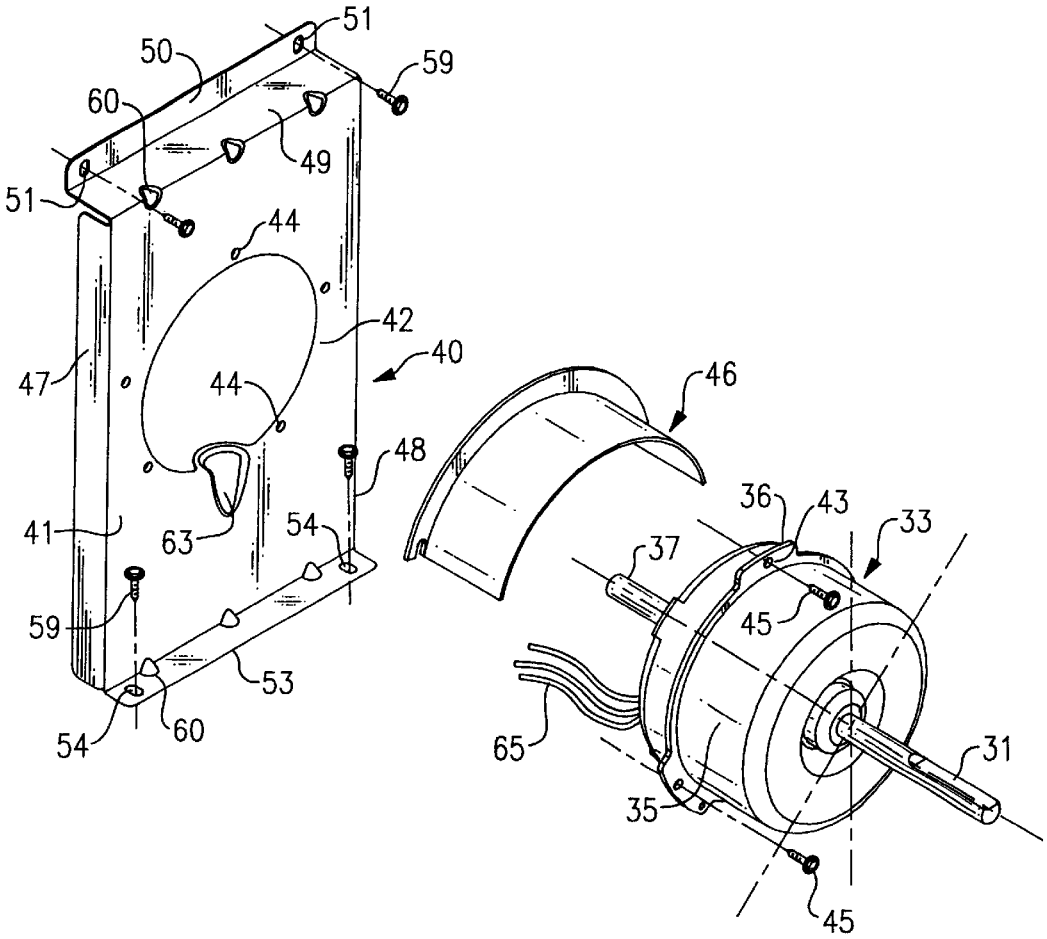
FIG. 4 is an enlarged exploded view in perspective showing the motor and motor mount.

With further reference to FIGS. 2–4, the rear outdoor section 20 of the unit is illustrated in greater detail. The outdoor section of the unit is separated from the indoor section 21 (FIG. 3) by a dividing wall 23 that closes tightly against he interior of the sleeve so that outdoor air cannot enter the indoor section under uncontrolled conditions. A door 25 is provided in the divider wall which can be adjustably opened to allow a given amount of outside air to pass through the door opening 26 and be mixed with indoor air under controlled conditions.

The dividing wall 23 is seated upon the base pan 27 of the unit. The outdoor fan 30 of the unit is mounted upon shaft 31 of a fan motor 33. The motor includes a cylindrical casing 35 and an annular bolting flange 36 that surrounds the casing. A second front shaft 37 protrudes forward of the motor casing and is arranged to pass through the dividing wall into the front section of the air conditioning unit. Although not shown, the indoor fan of the unit is secured to the front shaft and is arranged to pass comfort air over the indoor heat exchanger.

In assembly, the motor is supported in a motor mount generally referenced 40 (FIG. 4). Preferably, the mount is fabricated from a single piece of sheet metal, however, it can be molded from a suitable plastic material without departing from the teachings of the present invention. The mount includes a rectangular front panel 41 that contains a circular opening 42 for slidably receiving the front end of the motor casing therein. The bolting flange of the motor is brought into contact with the front face of the panel and the holes 43 in the flange are placed in alignment with receiving holes 44 that surround the opening 42. Threaded fasteners, such as self taping screws 45 are passed through the aligned holes to securely fasten the flange to the front panel. A snow shield 46 is placed over the motor casing and is similarly secured to the front face of the front panel using threaded fasteners.

A pair of opposed side walls 47 and 48 are cojoined to the side edges of the front panel. The side walls extend along the length of the panel and are perpendicularly aligned with the panel and extend back in a rearward direction. A top wall 49 is cojoined with the top edge of the panel and extends across the width of the panel. The top wall is also perpendicularly aligned with the front panel and extends rearward from the panel. A vertically disposed mounting strip 50 extends upwardly along the back edge of the top wall and contains a series of holes 51—51 through which threaded fasteners can be passed. A horizontally disposed mounting strip 53 extends outwardly along the bottom edge of the front panel and also contains a series of holes 54—54 through which threaded fasteners can be passed.

In assembly, the back of the vertically disposed mounting strip 50 is placed against the back of the dividing wall and the horizontally disposed mounting strip 53 is similarly placed against the top of the unit base pan 27. The mounting strips are secured in place using self taping screws 59 that are passed through the receiving holes in the strips and threaded into the dividing wall and the base pan to secure the mount and the motor in assembly.

Reinforcing gussets 60 are located between the horizontal mounting strip and the front panel as well as between the top wall and the front panel. The gussets are formed by stamping depressions in the metal using well known stamping techniques. The gussets provide additional strength to the mount so that the mount can readily withstand motor induced stresses and prevent the motor and thus the unit fans from vibrating under load. A cusp 63 is also formed in the front panel along the motor receiving opening by again deforming the panel as illustrated in FIG. 4. The cusp is large enough to allow electrical lines 65 (FIG. 3) to pass therethrough.

In assembly, the front end of the motor casing is located adjacent to the dividing wall and the front shaft of the motor passed through a suitable opening in the wall. Once the motor is secured in place, the indoor and outdoor fans then secured to the front and rear motor shafts completing the assembly.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. In an air conditioning unit having a horizontal base pan, a vertical divider wall mounted upon said base pan and a fan motor having an annular bolting flange surrounding the motor casing, a motor mount for supporting said motor in said unit that includes:

a rectangular vertically disposed front panel having an opening passing therethrough whereby the casing of said motor can be received in said opening to place the bolting flange of said motor in contact against said panel, mounting holes in said panel adjacent said opening, whereby said bolting flange of the motor can be secured to the panel by threaded fasteners, a pair of opposed side walls extending along side edges of said panel and a top wall extending along a top edge of said panel, said walls being perpendicular to said panel, a horizontal mounting strip extending outwardly from a bottom edge of said panel having receiving holes therein whereby said strip can be secured to said base pan by threaded fasteners that pass through said receiving holes, and a vertical mounting strip extending upwardly along an outer edge of said top wall and having receiving holes therein whereby said vertical strip can be secured to the divider wall of said unit by threaded fasteners that pass through said receiving holes.

2. The motor mount of claim 1 wherein the panel, the walls, and the mounting strips are integrally joined from a single piece of material.

3. The motor mount of claim 2 wherein said material is sheet metal.

4. The motor mount of claim 1 wherein the panel, the walls, and the mounting strip are integrally molded of plastic.

5. The motor mount of claim 3 that further includes gussets extending between the panel and said horizontal mounting strip.

6. The motor mount of claim 5 that further includes support gussets extending between the panel and said top wall.

7. The motor mount of claim 6 wherein said gussets are pressed deformities that are formed in the sheet metal.

8. The motor mount of claim 3 that further includes a cusp shaped indentation formed in said panel at the motor receiving opening whereby wires can pass between the motor casing and said panel.

* * * * *